US005190559A

United States Patent [19]

Gabion et al.

[11] Patent Number: 5,190,559

[45] Date of Patent: Mar. 2, 1993

[54] EPILATING APPLIANCE

[75] Inventors: Georges Gabion, Rillieux; Aimé Cleyet; Robert Roger, both of Lyons, France

[73] Assignee: Braun Aktiengesellschaft, Frankfurt, Fed. Rep. of Germany

[21] Appl. No.: 785,024

[22] Filed: Oct. 30, 1991

[30] Foreign Application Priority Data

Apr. 25, 1991 [FR] France ..... 91 05135

[51] Int. Cl.[5] ..... A45D 26/00

[52] U.S. Cl. ..... 606/133; 606/131

[58] Field of Search ..... 606/131, 133

[56] References Cited

U.S. PATENT DOCUMENTS 4,960,422 10/1990 Demeester .
5,032,126 7/1991 Cleyet et al. ..... 606/133
5,041,123 8/1991 Oliveau et al. ..... 606/133
5,084,055 1/1992 Demeester ..... 606/133

FOREIGN PATENT DOCUMENTS 0328426 8/1989 European Pat. Off. .

*Primary Examiner*—Stephen C. Pellegrino
*Assistant Examiner*—Glenn Dawson
*Attorney, Agent, or Firm*—Fish & Richardson

[57] ABSTRACT

The invention is directed to an epilating appliance with a casing 2 for accommodating a rotary cylinder 4 mounted on an axle 19 and adapted to be driven by a motor 10, the rotary cylinder having associated to it a plurality of pinching members 42, 43 provided with cutouts 44. The pinching members 42, 43 are capable of pivoting and moving into contact with each other in pairs by means of actuating members 26, 27 located at a distance to the axle 19 of the rotary cylinder 4 and displaceable against the action of at least one spring 39. In order to increase the lever arm for pivotal movement of the pinching members 42, 43, the pivot axis of the pinching members 42, 43 of the rotary cylinder 4 extends at a large relative distance to the axis of the rotary cylinder.

20 Claims, 5 Drawing Sheets

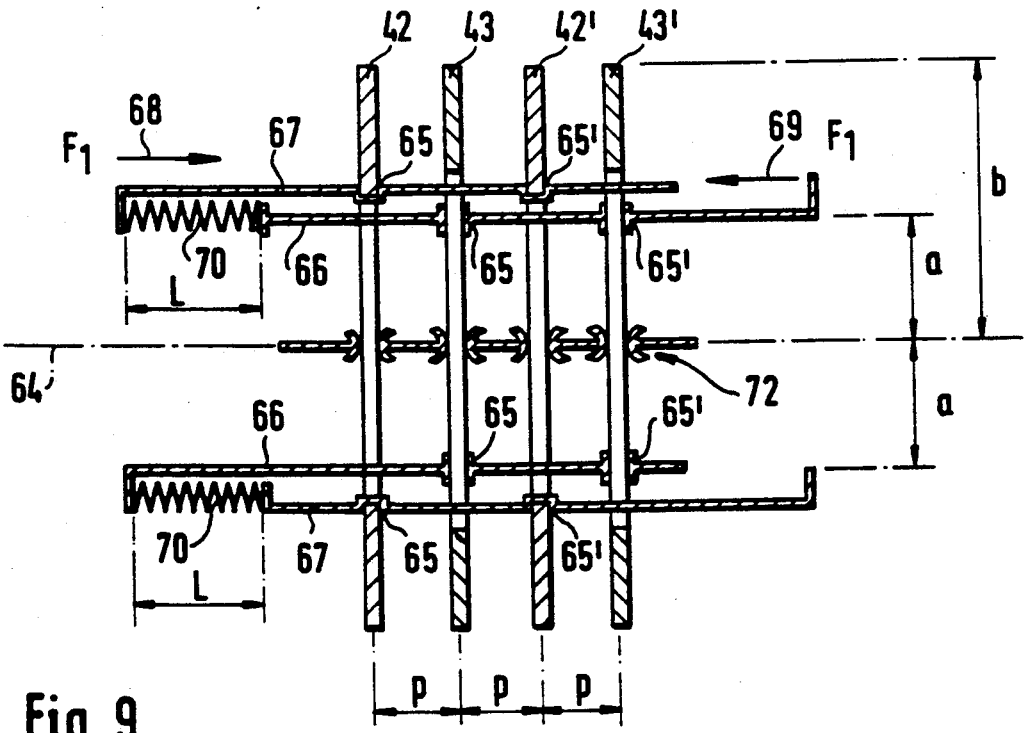
Fig. 9
Fig. 10
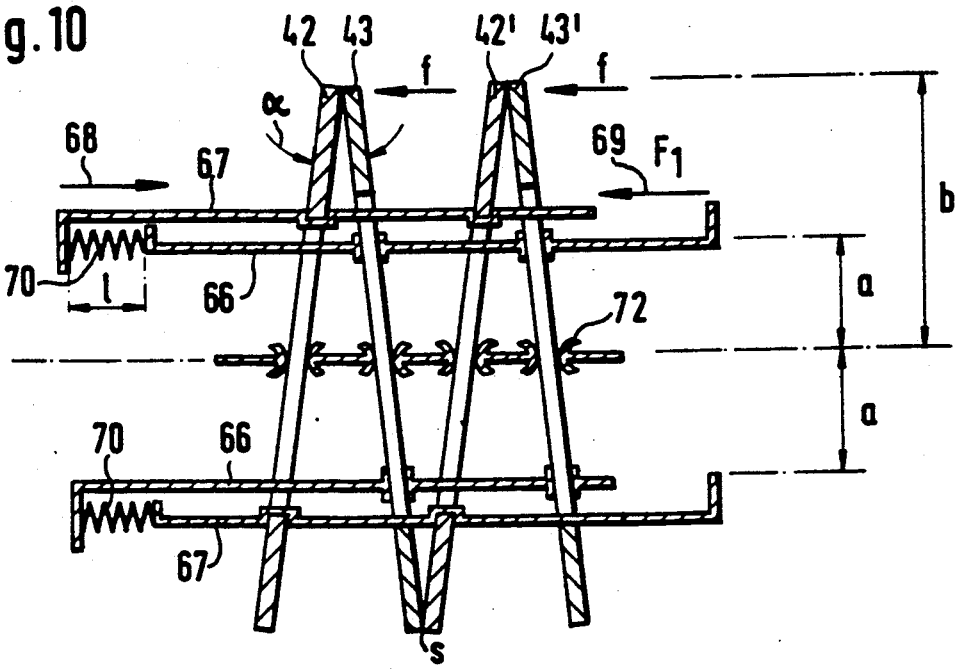

EPILATING APPLIANCE

This invention relates to an epilating appliance with a casing which is suitable for being held by a user's hand and serves to accommodate a rotary cylinder mounted on an axle and adapted to be driven by a motor, the rotary cylinder having associated to it a plurality of pinching members provided with cutouts, the pinching members being capable of pivoting and moving into contact with each other in pairs by means of actuating members which are located at a distance to the axle of the rotary cylinder and are displaceable against the action of at least one spring.

An appliance for the removal of body hairs is already known (EP 0 328 426 A2) which is comprised of a housing having a detachable epilation head. The housing further serves the function of receiving a rotary cylinder mounted on a shaft and adapted to be driven by a motor, with a plurality of pinching members having rectangular cutouts being arranged on the rotary cylinder. The pinching members are pivotal and movable into contact with each other in pairs by means of actuating members arranged at a distance to the shaft of the rotary cylinder. On completion of an operation cycle, the actuating members which are displaceable in opposite directions can be invariably returned to their neutral positions by means of a spring, with the initial position of the pinching members being also restored as this occurs. In this position, the individual pinching members are in parallel arrangement with each other. The individual pinching members are pivotally mounted on a shaft extending coaxially with the rotary cylinder of the epilation head. The individual pinching members being pivotal on the center axis of the rotary cylinder, they form a relatively large angle while in their pinching position, so that the pinching members, in assuming their pinching position, frequently merely cut the hairs off with their abutting edges instead of removing them. In addition, the lever arm with which the actuating members act on the pinching members is relatively small.

Accordingly, it is an object of the present invention to improve upon the kinematics of the epilating appliance and configure it such as to enable hairs to be removed easily without incurring the risk that the abutting edges of the pinching members cut the hairs off.

According to the present invention, this object is accomplished in that the pivot axis of the pinching members extends at a distance to the axis of the rotary cylinder. Owing to the favorable relocation of the pivot of the pinching members of the invention outside the area of the axis of the rotary cylinder, the actuating forces required for displacement of the pinching members can be substantially reduced. This is accomplished simply by increasing the lever arm for displacement of the pinching members, without necessitating a substantial modification of the epilation head of the appliance.

By reducing the force expended to displace the pinching members, the wear occurring on all movable parts can also be significantly reduced, thus adding to a prolonged life of the appliance in a simple manner. In consequence of the reduced expenditure of force, the individual components of the epilating appliance may also be dimensioned such as to be of lighter weight. Overall, this enables the manufacturing cost of the appliance to be reduced considerably.

Further, the pivot axis of the pinching members advantageously lies on the one side, and the point of engagement of two cooperating or abutting pinching members lies on the other side, of the axis of the rotary cylinder.

According to a further form of construction of the device of the invention, an additional possibility is that the relative distance of the pivot axis of the pinching members to the axis of the rotary cylinder is equal to or smaller than the relative distance of the axis to the point of engagement of two cooperating or abutting pinching members. This provides a simple way of increasing the lever arm for pivoting the individual pinching members which is nearly as large as the total length of a pinching member, that is, about twice as large as in the known appliances.

In another form of construction of the present invention, two relatively displaceable actuating members each are advantageously provided on either side of the axis, lying in the same longitudinal center plane as the axis of the rotary cylinder. This results in a very simple and space-saving structure of the epilation head, considering that all essential parts pertaining to the epilation head are located in one plane.

Finally, in a preferred embodiment of the solution of the invention, the cutout provided in the pinching members for receiving the actuating member and the axle is sufficiently large to enable the pinching members to perform pivotal movements about a corresponding junction between pinching member and actuating member.

A highly advantageous connection between actuating member and pinching member is obtained in that each actuating member includes a plurality of equidistantly spaced slots into which the drivers or noses of the pinching members engage and about which the pinching members are pivotal.

It is of particular importance for the present invention that the first pinching member and the pinching member following the next pinching member are adapted to be pivoted by an actuating member by means of drivers engaging in slots of the actuating member, and that the second pinching member and the pinching member following the next pinching member are adapted to be pivoted by the second actuating member lying on the same plane as the first actuating member equally by means of drivers engaging in slots of the second actuating member, if the actuating members lying on the side of the axis are relatively displaceable. In this connection it is advantageous that a relative displacement of the actuating members lying on the one side of the axis does not affect the position of the actuating members lying on the other side of the axis. This provides a simple way of utilizing the increased lever arm for displacement of the pinching members. It is further ensured that on half a revolution of the rotary cylinder only two of the four actuating members are telescoped together at a time, thereby producing the displacement of the pinching members. In this manner, the pinching action occurs in alternating sequence using simple constructional means, which ensures that the entire skin surface to be epilated is covered.

Further, it is advantageous that on a relative displacement of the actuating members lying on the one side of the axis, the position of the actuating members lying on the other side of the axis is retained. This enables the angle a enclosed between two cooperating pinching members to be maintained small, so that a larger area is available for the pinching action and the hair to be epilated is thus prevented from being cut off by the edges of the pinching members.

Moreover, it is advantageous that on a relative displacement of the actuating members lying on the one side of the axis the two parallel sides providing the cutout are moved past the outsides of the two actuating members and the sides of the axle bearing structure having a rectangular cross-section.

According to a further form of construction of the device of the invention, an added possibility is that the first and the third pinching member, on the one side of the axis, are in cooperative relation with the actuating member having a plurality of slots arranged in two rows, and, on the other side of the axis, are in cooperative relation with the actuating member having a plurality of slots arranged in a single row, while the situation is reverse with the second and fourth pinching member.

In a still further form of construction of the invention, the axle advantageously has at either end a slotted opening extending in the direction of the axle and open towards the respective end, for removably receiving a respective arm of a U-shaped bracket.

In a still further form of construction of the invention, each arm has advantageously located on it a pressure means which, on each revolution through 180°, abuts against the outer end of an actuating member, causing relative displacement of the actuating members against the action of the spring. An additional possibility afforded by a further form of construction of the device of the invention consists in that the pressure means is rotatably mounted on the arm of the bracket as a pressure roller. For reducing the running noise of the epilating cylinder, it is further advantageous to provide between the respective pressure roller and the respective end of the rotary cylinder a respective disk diminishing running noise and wear.

In order to ensure that the actuating members are displaced within a specific area only, the pinching members which are returnable and displaceable in opposite direction by the spring are advantageously movable against at least one stop.

Further details of the present invention will be set out and illustrated in the subclaims, the description and the Figures, it being understood that all single features and all combinations of single features are essential to the invention.

An embodiment of the invention will now be described by way of example without being limited to this particular embodiment, reference being had to the accompanying drawings, in which:

FIG. 9 is a schematic illustration of the known rotary cylinder showing the associated pinching members in neutral position;

FIG. 10 is a schematic illustration of the known rotary cylinder showing the associated pinching members in pinching position;

Figure 1:
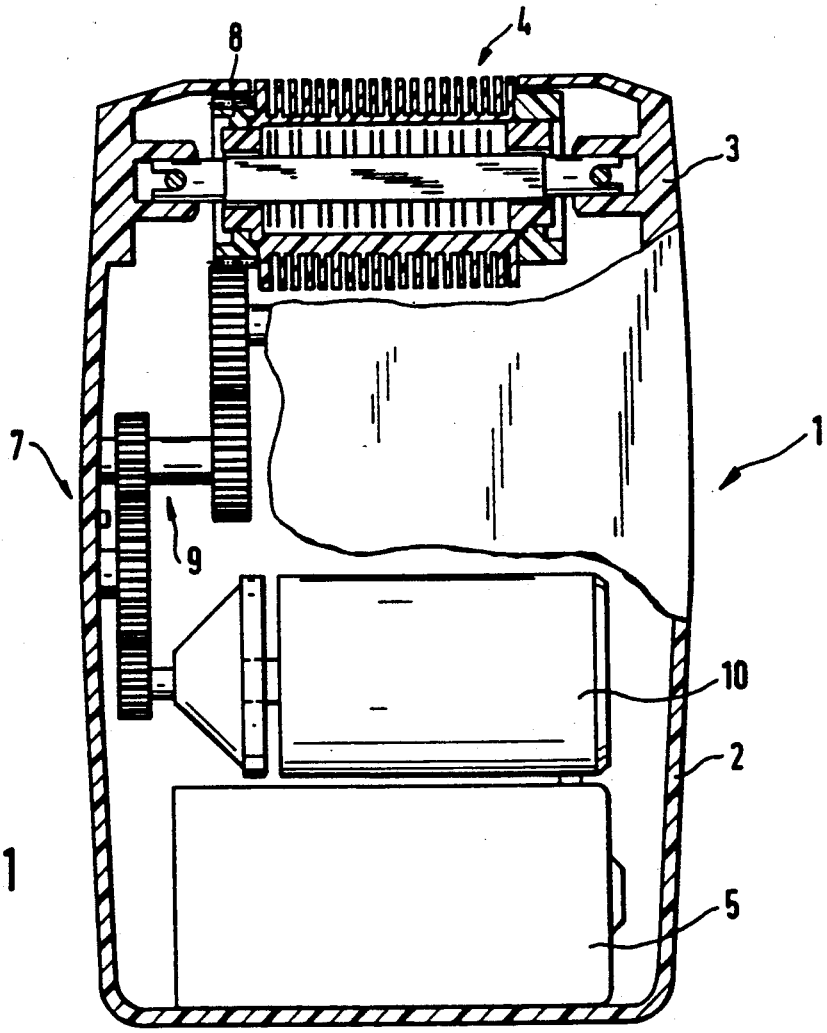
FIG. 1 is a front view, partially in section, of an epilating appliance shown schematically and including only the essential parts, with an electric drive motor for driving a rotary cylinder equipped with pinching members.

Referring now to the drawings, there is shown, partially in section, an appliance for the removal of human body hairs or an epilating appliance designated by reference numeral 1, which is comprised of a casing 2 and a demountable epilation head 3 for receiving a rotary cylinder 4 mounted so as to be drivable.

The rotary cylinder 4 is driven by an electric drive motor 10 which is adapted to be connected to a power line or a rechargeable accumulator 5 or an exchangeable battery pack.

The drive motor 10 is in driving relationship with a driving gear 8 of the rotary cylinder 4 through a gear train 7 comprising a plurality of gears 9.

Figure 2:
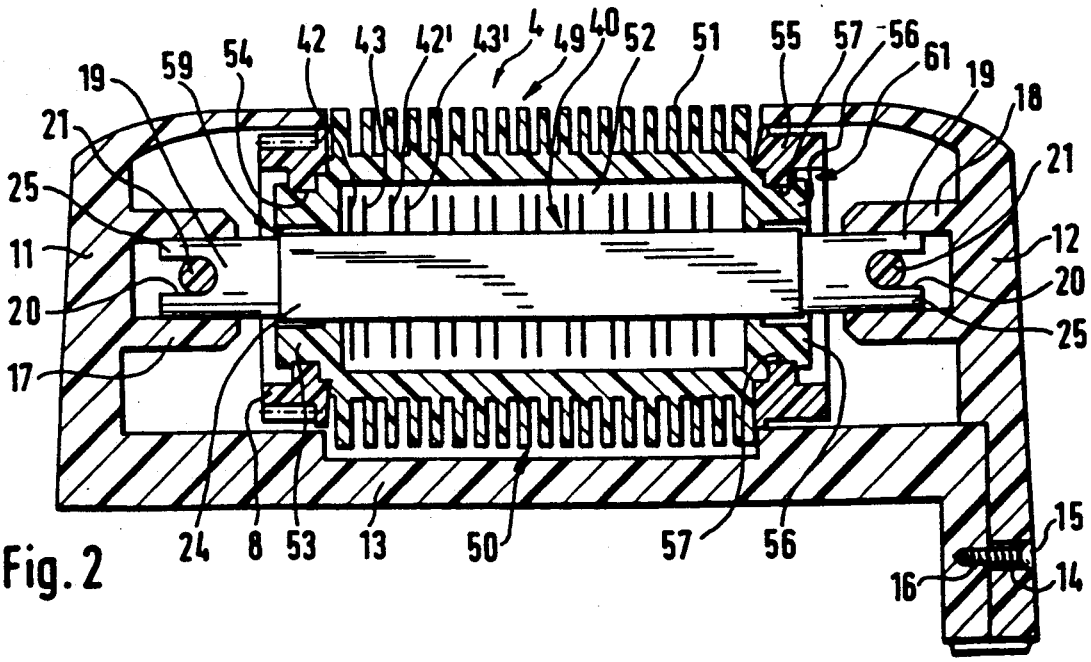
FIG. 2 is a sectional view of the rotary cylinder shown in neutral position in which the individual pinching members extend parallel with each other.

According to FIG. 2, the epilation head 3 which is seatable on the casing 2 includes a left-hand bearing shell 11 which is fixedly or integrally connected with a horizontally extending supporting structure 13. Further connected to the supporting structure 13 is a removable right-hand bearing shell 12 which is secured by a screw 15 extending for this purpose through a bore 14 in the bearing shell 12 and through a tapped hole 16 in the supporting structure 13 of the bearing shell 11.

The bearing shells 11 and 12 include each a respective bearing bush 17 and 18 to carry an axle 19 on which the rotary cylinder 4 is rotatably mounted. At either end of the axle 19, a respective cylindrical slotted opening 20 is provided through which a respective arm 21 of a bracket 22 shown in side view in FIG. 3 extends.

As becomes further apparent from FIG. 2, two threading means 49, 50 configured in shell shape are arranged to the right and left of, and above and below, a plurality of adjacent pinching members 42 and 43, the threading means having a plurality of adjacent parallel laminae 51 which serve the function of raising the body hairs such as to cause them to enter the space 52 between two cooperating pinching members 42, 43 readily.

The threading means 49, 50 are arranged on, and removably attached to, a bearing structure 24 surrounding the axle 19. To this end, the threading means 49, 50 have at their right and left ends respective shoulders 53 and 56 having each a respective groove 54 and 57. The gear 8 is received within the groove 54, and a disk 55 is received within the groove 57, of the diametrically opposite shoulders 53 and 56 of the threading means 49, 50. As the gear 8 and the disk 55 are being mounted, the two respective shoulders 53 and 56 are deformed such as to enable the gear 8 and the disk 55 to be received within the respective groove 54, 57 readily. In this manner, a clamping coupling is established between the bearing structure 24 of the axle 19 and the threading means 49, 50 at either end of the threading means 49, 50.

Further, the gear 8, the disk 55 and the numerous pinching members 42, 43 have each a rectangular opening 59, 44, 61 to enable the pinching members 42, 43, the gear 8 and the disk 55 to be slipped onto the bearing structure 24. These parts are, among others, constituent parts of a rotary cylinder 4 which is rotatably mounted on the axle 19 of the rotary cylinder 4 through the bearing structure 24 and is driven by the gear 8.

Figure 3:
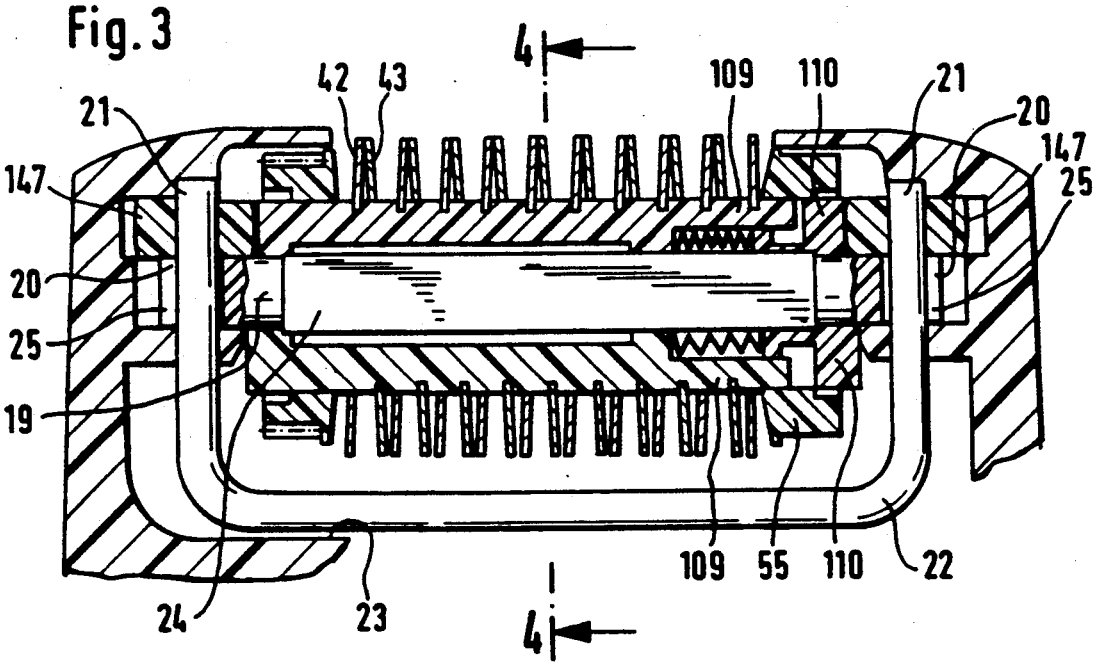
FIG. 3 is another sectional view of the rotary cylinder shown in pinching position in which the individual pinching members have their outer ends in relative abutting engagement.

As becomes further apparent from FIG. 3, the bracket 22 is received in the epilation head 3 within a groove 23 of which only a fragment is shown in the drawing.

The axle 19 of the rotary cylinder 4 of the epilation head 3 of FIG. 3 serves to rotatably receive the center rectangular elongate bearing structure 24. The axle 19 protruding from either end of the bearing structure 24 has at either end a journal 25 provided with a respective slotted opening 20.

Mounted on the upper side and the diametrically opposite lower side of the bearing structure 24 are two pairs of actuating members or actuating bars 26, 27 and 28, 29 capable of being telescoped together.

Figure 6:
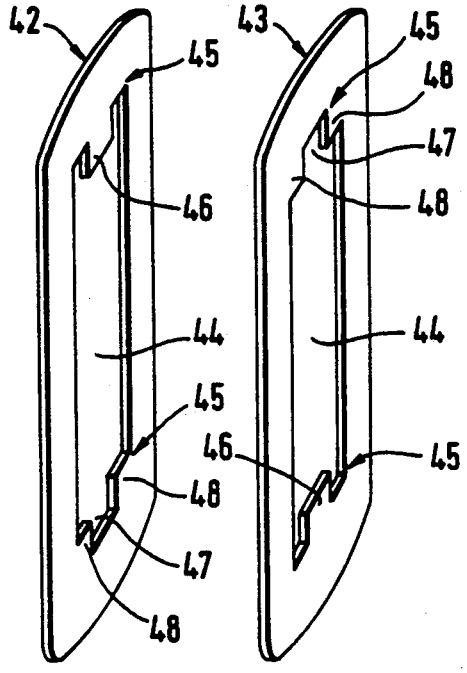
FIG. 6 is a view of two adjacent pinching members which are adapted to be seated on the actuating members of FIG. 5 and moved by them in opposite directions.
Figure 7:
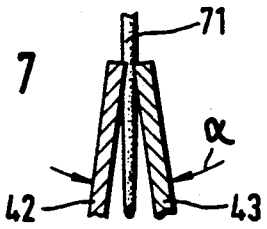
FIG. 7 is a view of two known pinching members shown in pinching position.
Figure 8:
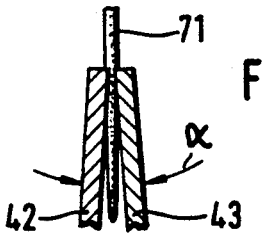
FIG. 8 is a view of the pinching members of the invention shown in pinching position.

As becomes still further apparent from FIG. 3, the pinching members 42 and 43 shown in detail in FIGS. 6 to 8 are arranged on the actuating bars 26 to 29 and coupled thereto in a driving relationship. Numerous pinching members 42, 43 cooperate to form a pinching device for the removal of human body hairs. The pinching device is part of the rotary cylinder 4.

Figure 5:
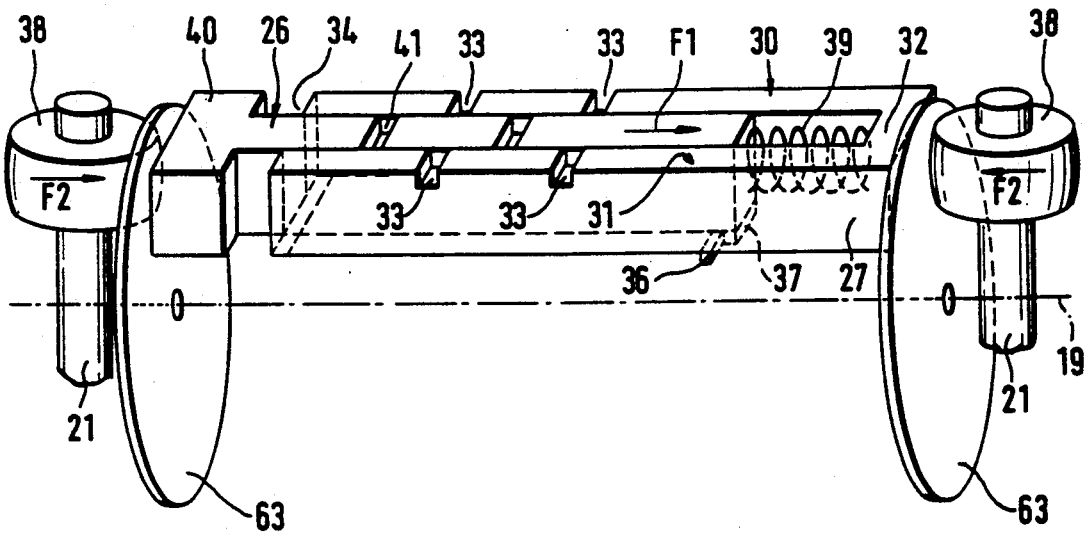
FIG. 5 is a perspective view of two actuating members and their associated pressure rollers.

The two upper actuating bars 26, 27 are shown in perspective in FIG. 5. The one actuating bar 27 is of a U-shaped configuration and includes rods 30, 31 in parallel arrangement interconnected at one of their ends by a cross-member 32. Provided on the upper side of the two parallel rods 30, 31 are numerous slots 33 uniformly spaced and forming a right angle with a respective one of the longitudinal sides of the rods 30, 31. The slots 33 of the rod 31 lie on the same transverse plane as the slots 33 of the adjacent rod 30.

The two parallel rods 30, 31 form a U-shaped recess 34 in which the actuating bar 26 is received axially slidably. According to FIG. 5, a spring 39 normally holding the actuating bar 26 in its neutral position is disposed between the right-hand end of the actuating bar 26 and the cross-member 32. In the position illustrated in FIG. 5, the actuating bars 26 and 27 are telescoped together by means of abutments or pressure rollers 38 provided at either end of the actuating bars against the action of the spring 39. Once the actuating bars are moved past the pressure rollers, the spring 39 will cause the actuating bars to be moved into the opposite direction until the transversely extending stop 37 provided on the actuating bar 26 abuts against the stop 36 provided on the actuating bar 27. This prevents the actuating bar 26 from being pushed out of its engagement with the recess 34.

As shown in FIG. 5 and FIG. 3, a pressure means which may be configured as a pressure roller 38 is provided on either arm 21 of the U-shaped bracket 22. In the position illustrated in FIG. 5, rotation of the rotary cylinder 4 causes the left-hand pressure roller 38 to urge the actuating bar 26 against the action of the spring 39, which occurs when the pressure roller 38 is moved along the T-shaped portion 40 of the actuating bar 26.

As this actuating operation proceeds, the slots 41 provided in the actuating bar 26 are displaced to the right in conjunction with the slots 33 of the two rods 30, 31 of the actuating bar 27. When the left-hand pressure roller 38 urges the actuating bar 26 into the recess 34 of the actuating bar 27, the actuating bar 27 will bear against the right-hand pressure roller 38.

In FIG. 5, a respective disk 63 is additionally inserted between the pressure roller 38 and the respective ends of the actuating bars 26 and 27, causing the pressure roller 38 to act upon the actuating bars 26, 27 through the disk 63 as a result of which running noise and wear are reduced.

In FIG. 6, two pinching members 42 and 43 normally lying closely adjacent to each other are shown. The left and right pinching member 42, 43 has each a rectangular cutout 44. A downwardly extending nose 46 is provided at the top end 45 of the cutout 44 of the left-hand pinching member 42. In addition, an upwardly open recess 47 is provided at the bottom end 45 of the cutout 44 of the left-hand pinching member 42.

The right-hand pinching member 43 illustrated in FIG. 6 is shown in a position turned through 180°, that is, a recess 47 is provided at the top end of the pinching member 43, while the nose 46 is at the bottom end thereof.

A plurality of adjacent pinching members 42, 43 combine with the remaining components to provide a device for the removal of human body hairs.

To accomplish this, the pinching members are mounted on the actuating bars 26 to 29 of which the upper actuating bars are shown in FIG. 5 while the lower actuating bars are not shown in this Figure. For mounting, the upper noses 46 of the pinching members 42 engage into the respective slots 41 of the center actuating bar 26, while the drivers 48 bounding the cutout engage into the opposite slots 33 of the two parallel rods 30, 31.

The arrangement is similar with the bottom portions of the pinching members 42, 43. The two drivers 48 of the pinching member 42 engage into the slots 33 of the two outer rods 30, 31, so that each pinching member 42 is coupled in a driving relationship by engagement of the upper nose 46 with the center actuating bar 26 on the one part, and by engagement of the two bottom drivers 48 with the outer rods 30, 31 of the U-shaped actuating bar 27 on the other part.

Figure 4:
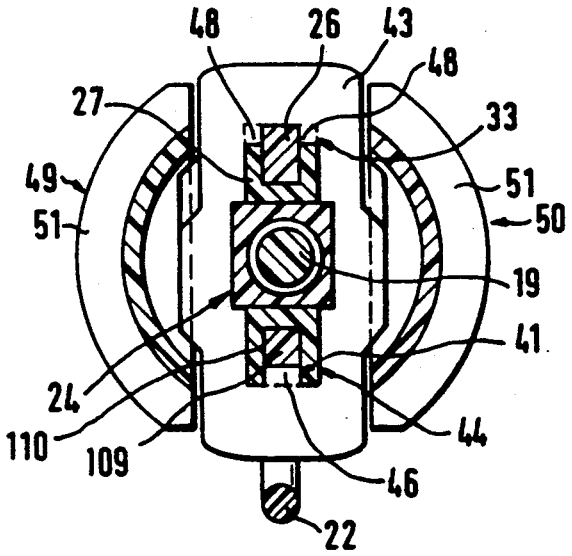
FIG. 4 is a sectional view of the rotary cylinder, taken along the line A—A of FIG. 3.

FIG. 4 illustrates in a sectional representation how the individual pinching members 42 and 43 are in relative driving engagement with the upper actuating bars 26, 27 and the lower actuating bars 28, 29. The upper drivers 48 of the pinching member 43 engage into the two opposite slots 33 of the actuating bar 27, while the nose 46 of the same pinching member 43 engages into the slot 41 of the center actuating bar 28.

The mode of function of a known epilating appliance will be explained in the following with reference to FIGS. 9 and 10, while the mode of function of the epilating appliance of the invention will be explained with reference to FIGS. 11 and 12. In order to be able to better illustrate the sequence of motions, only the essential parts are shown in these Figures.

Further, for ease of understanding, only four pinching members 42, 43, 42', 43' are shown in FIGS. 9 to 12.

In FIG. 9, the epilating appliance is shown in a neutral position before the pinching members 42, 43 are moved into an operating position. In this neutral position, the four pinching members 42, 43, 42', 43' extend parallel with each other.

The four pinching members 42, 43 and 42', 43' are pivotally connected to a center supporting bar 64. Further, the pinching members 42, 42' are guided in slots 65, 65' of the actuating bar 67. In between are the pinching members 43, 43' which are guided in slots 65, 65' of the actuating bar 66.

On a first half revolution of the rotary cylinder 4, the upper and lower actuating bars 66, 67 are telescoped together against the action of a respective spring 70 in the direction of arrows 68, 69, causing the outer ends of the pinching members 42, 43 and 42', 43' to be moved into relative engagement, as shown in FIG. 10. As this occurs, the pinching members 42, 43 and 42', 43' enclose a relatively large angle $\alpha$ as shown in FIG. 10, so that part of the pinched hairs 71 (see FIG. 7) may already be cut off by the abutting edges of the pinching members 42, 43 and 42', 43' instead of being plucked out, as desired.

On further rotation of the rotary cylinder 4 through 180°, the lower actuating bars 66, 67 are moved up, and by telescoping together the previously lower actuating bars 66, 67, only the two center pinching members 43, 42' are brought into relative engagement (whilst the remaining pinching members are not shown, their relative movement occurs in the same manner). At the same time, the previously upper actuating members 66, 67 are telescoped together. A pinching action in alternating sequence is thereby accomplished.

The springs 70 shown in FIGS. 9 and 10 serve the function of returning the pinching members 42, 43 and 42', 43' into a neutral position. For ease of understanding, the actuating bars 66, 67 illustrated in FIGS. 9 to 12 are shown as being infraposed, although in actual fact they are located at the same relative distance to the axis 64 (see FIGS. 2 and 3).

In the known arrangement, it is a disadvantage that the individual pinching members 42, 43 and 42', 43' pivot about their center pivot 72 on the axis 64.

On displacement of the pinching members 42, 43 and 42', 43', a respective force $F_1$ will act on the actuating bars 66, 67 in the direction of arrows 68, 69. Accordingly, the force $F_1$ is equal to the sum of the pinching forces f (see FIG. 10) in the ratio of the lever arms a and b. This force is assisted by the force of the spring 70. The following formula follows thence:

$$F_1 = df \times b/a + 2r(L-1)$$

where:

r = spring constant

L = length of spring in released condition l = length of spring in compressed condition a,b = distances between actuating members p = distance between pinching members in neutral position $\alpha$ = angle between pinching members in working position S = point of contact of outer ends of pinching members $F_1$ = actuating force f = bearing force of pinching members On abutting engagement of the pinching members 42, 43 and 42', 43' in point S, additional forces additive to force F1 will occur.

Figure 11:
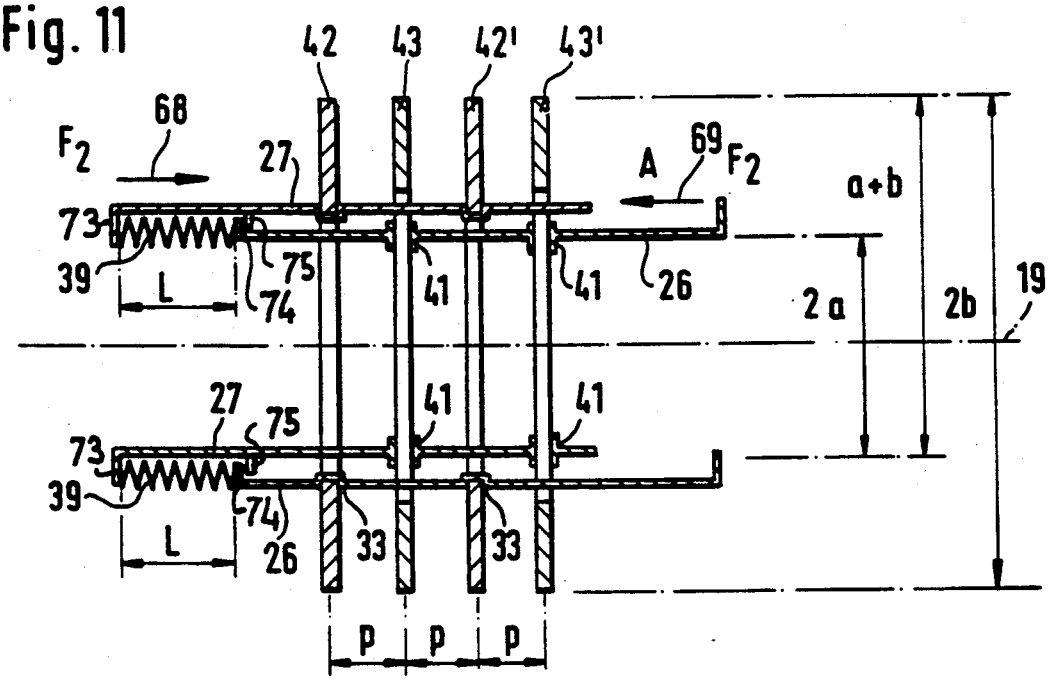
FIG. 11 is a schematic illustration of the rotary cylinder of the invention showing the associated pinching members in neutral position.
Figure 12:
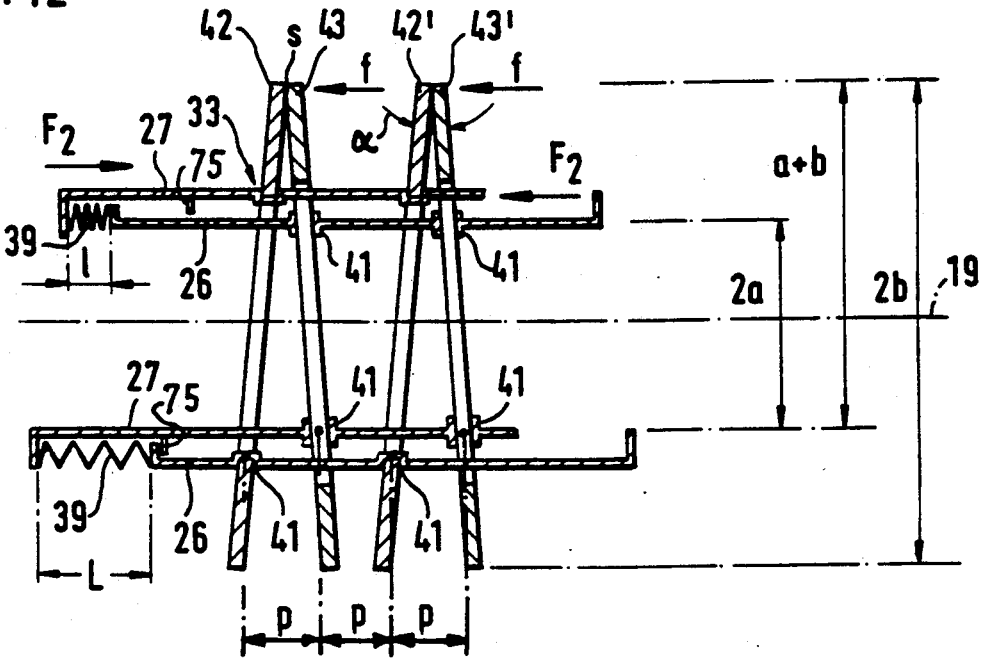
FIG. 12 is a schematic illustration of the rotary cylinder of the invention showing the associated pinching members in pinching position.

With the arrangement of the pinching members 42, 43 and 42', 43' according to the invention and as shown in FIGS. 11 and 12, a substantial improvement of the pinching effect is obtained in the area of the outer ends or tips S of the pinching members 42, 43 and 42', 43', so that a smaller angle $\alpha$ results when catching individual hairs 71 (according to FIG. 8) than with the known arrangement of FIG. 7. In consequence, the inwardly pointing or abutting edges just clamp the hairs 71, rather than cutting them off as in the prior arrangements.

Such a small angle $\alpha$ formed between the pinching members 42, 43 of the invention is obtained by providing the pivot of the pinching members 42, 43, 42', 43', rather than on the axis of the supporting bar 64 as heretofore (see FIGS. 9, 10; pivot 72), on the plane of the actuating bars 26, 27, that is, the pivot of the pinching members is at the same relative distance to the axis of rotation of the rotary cylinder as the actuating bars 26 to 29.

Accordingly, when the pressure rollers 38 cause the two upper actuating bars 26, 27 to be telescoped together by means of a force F2 in the direction of the arrow against the action of the spring 39, so that they leave the position shown in FIG. 11 and assume the position shown in FIG. 12, then the pinching members 42, 43 will pivot in the lower slots 33, 41 of the two lower actuating bars 26, 27.

According to FIGS. 11 and 12, the spring 39 rests with its left end against a left-hand abutment means 73 and with its right end against a right-hand abutment means 74. As becomes apparent from the position of the pinching members 42, 42', 43, 43', this position is defined by a stop 75 fixedly provided on the actuating member 27, thus preventing the pinching members 42, 42', 43, 43' from being displaced beyond this position During the pivoting operation, only the upper spring 39 is compressed to length 1, while the lower spring 39 maintains its length L. In the process, the lower spring 39 bears with its one end against the left-hand abutment means 73 and with its other end against the right-hand abutment means 74 and the stop 75, thereby retaining its position shown in FIG. 12. In contrast, the spring 70 of the known arrangement of FIG. 10 is compressed.

From this it also results that the force to be expended for displacement of the pinching members 42, 43 of the invention is smaller than the force required for displacing the known pinching members 42, 43.

The force $F_2$ for displacement of the pinching members 42, 43 is obtained from the following formula:

$$F_2 = df \times b + a/2a + r(L-1)$$

Comparing this formula $F_2 = df \times b + a/2a + r(L-1)$ for the force $F_2$ with the formula $$F_1 = df \times b/a + 2r(L-1)$$

for the known type of displacement of the pinching members 42, 43, it results $$F_2 < F_1$$

From this result the following advantages for the arrangement of the invention:

Owing to the favorable relocation of the pivot of the pinching members 42, 43 of the invention into the path of travel of the actuating bars 26, 27, the actuating forces $F_2$ for displacement of the pinching members 42, 43 can be substantially reduced. This enables the wear of all movable parts to be reduced significantly, resulting in a prolonged life of the appliance by simple means. Because the actuating forces can be reduced with the arrangement of the invention, it is also possible to dimension the individual components of the epilating appliance such as to be of lighter weight, so that overall the manufacturing cost of the appliance can be reduced.

We claim:

1. An epilating appliance comprising a casing which is suitable for being held by a user's hand, axle structure in said casing, a motor in said casing, rotary cylinder structure in said casing mounted on said axle structure and adapted to be driven in rotation by said motor about a central axis that extends along said axle structure and extends generally parallel to the surface of the skin to be epilated, a plurality of pinching members mounted in series relation on said rotary cylinder structure for rotation therewith, spring structure, and actuating member mounted in series relation on said rotary cylinder structure for rotation therewith, spring structure, and actuating member structure comprising a plurality of actuating members displaceable against the action of said spring structure for pivoting said pinching members in pairs about pinching member pivot axes that are disposed at a distance from said central axis and extend generally perpendicular to said central axis of said rotary cylinder structure to move tips of adjacent pinching members of said pairs into engagement with each other at engagement points.

2. The epilating appliance of claim 1 wherein said pinching member pivot axes and the points of engagement (S) of said pinching members lie on opposite sides, of said central axis of said rotary cylinder structure.

3. The epilating appliance of claim 1 wherein the relative distance (a) of said pinching member pivot axes to said central axis of said rotary cylinder structure are equal to or smaller than the relative distance (b) of said central axis to the points of engagement (S) of said pinching members.

4. The epilating appliance of claim 1 wherein said actuating member structure includes two pairs of relatively displaceable actuating members, said two pairs of actuating members being provided on opposite sides of said central axis, and each said pair of actuating members being disposed generally in the same longitudinal plane with said central axis of said rotary cylinder structure.

5. The epilating appliance of claim 1 wherein each said pinching member has a cutout portion for receiving and providing a junction with said actuating member structure for pivoting the pinching member about said junction between said pinching member and said actuating member structure.

6. The epilating appliance of claim 1 wherein each said pinching member has a nose portion and said actuating member structure includes a plurality of equidistantly spaced slots into which said nose portions of said pinching members engage and about which said pinching members are pivotal.

7. The epilating appliance of claim 6 wherein each said pinching member has a driver portion and a first pinching member of each said pair in adapted to be pivoted by a first actuating member by means of one of said driver portions engaging in a slot of said first actuating member, and a second pinching member of each said pair is adapted to be pivoted by a second actuating member lying on the same plane as said first actuating member by means of another one of said driver portions engaging in a slot of said second actuating member, said first and second actuating members lying on the same side of said central axis and being displaceable relative to one another.

8. The epilating appliance of claim 7 wherein said pinching member pivot axis and said points of engagement (S) of said pinching members lie on opposite sides of said central axis of said rotary cylinder structure, and the relative distance (a) of said pinching member pivot axes to said central axis of said rotary cylinder structure are equal to or smaller than the relative distance (b) of said central axis to the points of engagement (S) of said pinching members.

9. The epilating appliance of claim 7 wherein said actuating member structure includes third and fourth actuating members disposed on the opposite side of said central axis from said first and second actuating members, and wherein a relative displacement of the actuating members disposed on one side of said central axis does not affect the position of the actuating members disposed on the other side of said central axis.

10. The epilating appliance of claim 7 and further including bearing structure that includes a member of rectangular cross-sectional configuration, and wherein each said pinching member has a cutout portion with opposed parallel sides that guided on opposed surfaces of said rectangular member, and each said actuating member is guided on a side of said rectangular member.

11. The epilating appliance of claim 1 wherein said actuating member structure includes two pairs of relatively displaceable actuating members, said two pairs of actuating members being provided on opposite sides of said central axis, each said pair of actuating members being disposed generally in the same longitudinal plane with said central axis of said rotary cylinder structure, each said pinching member has a cutout portion for receiving and providing a junction with said actuating member structure for pivoting the pinching member about said junction between said pinching member and said actuating member structure, each said pinching member has a nose portion, and said actuating member structure includes a plurality of equidistantly spaced slots into which said nose portions of said pinching members engage and form said junctions about which said pinching members are pivotal.

12. The epilating appliance of claim 11 and further including bearing structure that includes a member of rectangular cross-sectional configuration, and wherein the cutout portion of each said pinching member has opposed parallel sides that are guided on opposed surfaces of said rectangular member, and each said pair of actuating members is guided on respective opposed sides of said rectangular member.

13. The epilating appliance of claim 1 wherein a first pinching member of each said pair are in cooperative relation with one of said actuating members on one side of said central axis that has a plurality of slots arranged in two rows, and, on the other side of said central axis, said first pinching member of each second of said pair are in cooperative relation with a said actuating members having a plurality of slots arranged in a single row, while the situation is reverse with respect to the second pinching member of each said pair.

14. The epilating appliance of claim 1 and further including a U-shaped bracket member with upstanding spaced arms and wherein said axle structure has at either end a slotted opening extending in the direction of said central axis and each said slotted opening is open towards its adjacent end of said axis structure, for removably receiving a respective arm of said U-shaped bracket member.

15. The epilating appliance of claim 14 wherein each said arm has located on it a pressure means which, on each revolution of said rotary cylinder structure through 180°, abuts against the outer end of an actuating member and causes relative displacement of said actuating member against the action of said spring structure.

16. The epilating appliance of claim 15 wherein said pressure means includes a pressure roller rotatably mounted on one of said arms of said bracket member.

17. The epilating appliance of claim 16 and further including a disk disposed between each said pressure roller and the respective end of said rotary cylinder structure.

18. The epilating appliance of claim 15 and further including bearing structure that includes a member of rectangular cross sectional configuration, and wherein each said pinching member has a cutout portion with opposed parallel sides that guide on opposed surfaces of said rectangular member, and a first pair of said actuating members is guided on respectively opposed sides of said rectangular member.

19. The epilating appliance of claim 18 wherein said actuating member structure includes a second pair actuating members disposed on the opposite side of said central axis from said first pair of said actuating members, and wherein a relative displacement of the actuating members disposed on one side of said central axis does not affect the position of the actuating members disposed on the other side of said central axis.

20. The epilating appliance of claim 1 and further including stop structure and wherein said pinching members are displaceable in opposite directions by said spring structure and are limited in movement by said stop structure.

* * * * *

UNITED STATES PATENT AND TRADEMARK OFFICE

CERTIFICATE OF CORRECTION

PATENT NO. : 5,190,559

DATED : March 2, 1993

INVENTOR(S) : Georges Gabion et al.

It is certified that error appears in the above-identified patent and that said Letters Patent is hereby corrected as shown below:

Col. 9, lines 19-21, delete "mounted in series relation on said rotary cylinder structure for rotation therewith, spring structure, and actuating member".

Col. 9, line; 62, "in" should be --is--.

Signed and Sealed this

Seventh Day of December, 1993

Bruce Lehman

*Attest:*

BRUCE LEHMAN

*Attesting Officer*

*Commissioner of Patents and Trademarks*